US005107789A

United States Patent [19]

Salisbury

[11] Patent Number: 5,107,789

[45] Date of Patent: Apr. 28, 1992

[54] ARTICLE COATING SYSTEM

[75] Inventor: Richard Salisbury, Laguna Niguel, Calif.

[73] Assignee: Blodgett & Blodgett, P.C., Worcester, Mass.

[21] Appl. No.: 575,954

[22] Filed: Aug. 31, 1990

Related U.S. Application Data

[62] Division of Ser. No. 305,453, Feb. 10, 1989, Pat. No. 4,953,495.

[51] Int. Cl.[5] ..... B05B 13/02

[52] U.S. Cl. ..... 118/305; 118/309; 118/326

[58] Field of Search ..... 118/326, 305, 453, 309

[56] References Cited

U.S. PATENT DOCUMENTS

| | | | |
|---|---|---|---|
| 2,791,514 | 5/1957 | Mears | 118/320 |
| 2,798,008 | 7/1957 | Miller | 118/326 |
| 3,208,868 | 9/1965 | Strobel et al. | 118/326 |
| 3,750,622 | 8/1973 | Repp et al. | 118/326 |
| 4,354,451 | 10/1982 | Vöhringer et al. | 118/634 |
| 4,825,807 | 5/1989 | Nakamura et al. | 118/634 |
| 4,851,261 | 7/1989 | Gelain et al. | 118/326 |
| 4,898,116 | 2/1990 | Kozoe et al. | 118/324 |

FOREIGN PATENT DOCUMENTS 2910232 9/1980 Fed. Rep. of Germany ..... 118/634

*Primary Examiner*—Jay H. Woo
*Assistant Examiner*—Jeremiah F. Durkin, II
*Attorney, Agent, or Firm*—Blodgett & Blodgett

[57] ABSTRACT

A system for coating articles by the use of electrostatic attraction of ionized particles which are subsequently cured. The system includes a pair of carriers for jointly carrying each article through the system, from application of the particles to the article through curing of the particles on the article. Each carrier is capable of carrying the article independently of the other. After deposition of the particles on the article the article and the carriers are conveyed through a cleaning station wherein one of the carriers is moved out of carrying engagement with the article and cleaned while the article supported by the other carrier. The other carrier is then moved out of supporting engagement with the article and cleaned while the article is supported by the first carrier. The system also includes a spray booth for depositing the particles on the article which limits the exposure of the carriers to the spray of particles and includes a removable replaceable insert to eliminate the need for cleaning the spray booth when there is a change in the nature of the particles being used, such as color.

2 Claims, 9 Drawing Sheets

ARTICLE COATING SYSTEM

This is a divisional of copending application(s) Ser. No. 07/305,453 filed on Feb. 1, 1989, now U.S. Pat. No. 4,953,495.

BACKGROUND OF THE INVENTION

The present invention relates, generally, to a system for coating articles or workpieces and, specifically, for coating metalic articles using electrostatic attraction. The articles to be coated are transported or conveyed through the system by metalic supporting elements such as hooks which hang down from an overhead conveyer. The articles to be coated are grounded via the supporting elements. The articles are first conveyed through a spray booth where they are coated with ionized particles of an uncured material such as plastic resin. The particles are projected in the form of a spray from an electrode unit which charges and ionizes the particles. The particles are attracted to the grounded article and, hence, coat the article. The articles are then conveyed to a curing oven which fixes the particles to the articles to form a permanent coating on the articles. This process is used extensively in the plastic coating industry. The particles are also attracted to the supporting elements so that the supporting elements also become coated. This also means that the particles become fixed to the supporting elements when they are fixed to the article in the curing oven. After a few cycles, the conduction between the articles and the supporting elements ceases to exist. As a result, the quality of the treatment process quickly deteriorates.

In order to maintain an acceptable quality of coating on the articles the supporting elements for the articles must be replaced frequently. This results in a substantial loss of production. The coated supporting elements are either discarded and replaced by new supporting elements or cleaned. In either case, this represents an added cost to the process. At the present time, the preferred form of cleaning consists of burning the coating from the supporting elements. However, this creates two additional problems. The burning requires consumption of energy and creates toxic fumes which must be contained. The equipment for performing both of these tasks and the energy which is consumed therein add considerably to the cost of the coating operation.

Another problem with existing coating systems is that all the particles which are deposited on the carrying elements represent waste. A still further problem arises when the spray is changed to particles having different characteristics such as color. When the spray is changed, the spray booth must be thoroughly cleaned to avoid contaminating the articles with particles from the previous spray. The down time for cleaning the spray booth results in a substantial loss in production. These and other difficulties experienced with the prior art coating systems have been obviated by the present invention.

It is, therefore, a principle object of the invention to provide a system for coating articles by electrostatic attraction in which the particles are removed from the article supporting elements prior to curing of the particles on the article. Another object of the invention is the provision of a supporting element for articles to be coated by electrostatic attraction which enables the supporting elements to be cleaned of the particles while maintaining support of the article.

A further object to the present invention is the provision of a spray booth which limits the amount of deposit of spray particles on the supporting elements of the articles to be coated.

Another object of the present invention is to provide a spray booth for depositing particles on articles to be coated which does not require cleaning when the spray is changed to particles having different characteristics such as color, etc.

With these and other objects in view, as will be apparent to those skilled in the art, the invention resides in the combination of parts set forth in the specification and covered by the claims appended hereto.

SUMMARY OF THE INVENTION

In general, the invention consists of a system for applying a coating of loose particulate material to an article for subsequent fixing of the particulate material to the article, the article having a configuration which enables the article to be suspended on the free end of a projecting element. The system includes a connector for attachment to an overhead conveyer and a pair of carriers for jointly carrying the article. Each of the carriers has a lower free end portion for engaging the article and is mounted on the connector for movement relative to the connector from a lower article supporting position to an upper position in which the carrier is completely free of the article. The system also includes a booth having a chamber for receiving a spray of particulate material, and a cleaning station for removing the particulate material from each carrier in succession by first moving one carrier away from its article supporting position for removal of the particulate material therefrom while the article is supported by the other carrier and repeating the process for the other carrier. The article is transported through the chamber of the spray booth by an overhead conveyer, where it is coated with particulate material, and then through a cleaning station, where the particulate material is removed from the carriers. The article is finally conveyed to a curing oven wherein the particulate material is subsequently cured so that a permanent coating of material is formed on the article but not on the carriers.

The invention also consists of a spray booth which restricts the area of the carriers which is coated with the particulate material which comprises a removal insert which is removed and replaced by another insert each time that the spray is changed to a particulate material having different characteristics such as color, composition, etc.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
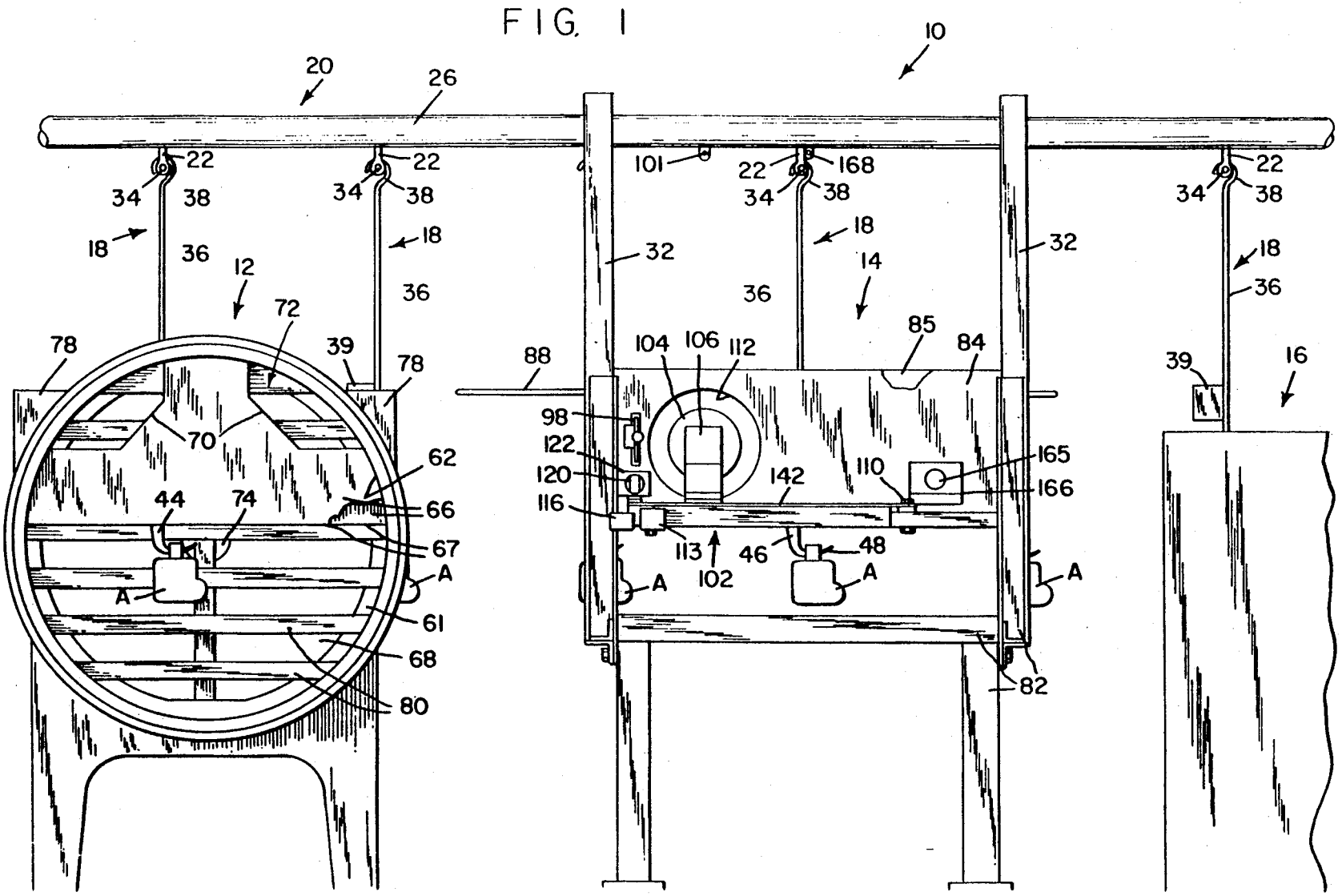
FIG. 1 is a front elevational view of a coating system embodying the principles of the present invention.

Referring first to FIG. 1 which shows the general features of the invention, the article coating system of the present invention is generally indicated by the reference numeral 10 and it comprises a spray booth, generally indicated by the reference numeral 12, a cleaning station, generally indicated by the reference numeral 14, and a curing oven, generally indicated by the reference numeral 16. The workpieces or articles to be coated are indicated by the letter A which are supported by suspension on hangers, generally indicated by the reference numeral 18, which are, in turn, suspended from an overhead conveyer which is generally indicated by the reference numeral 20. The articles to be coated are metalic and have a surface configuration which enables the articles to be supported by suspension on the free end of a projecting element. Such a surface configuration may include an aperture, hook, bracket, or any other structure which enable the article to be suspended.

Figure 4:
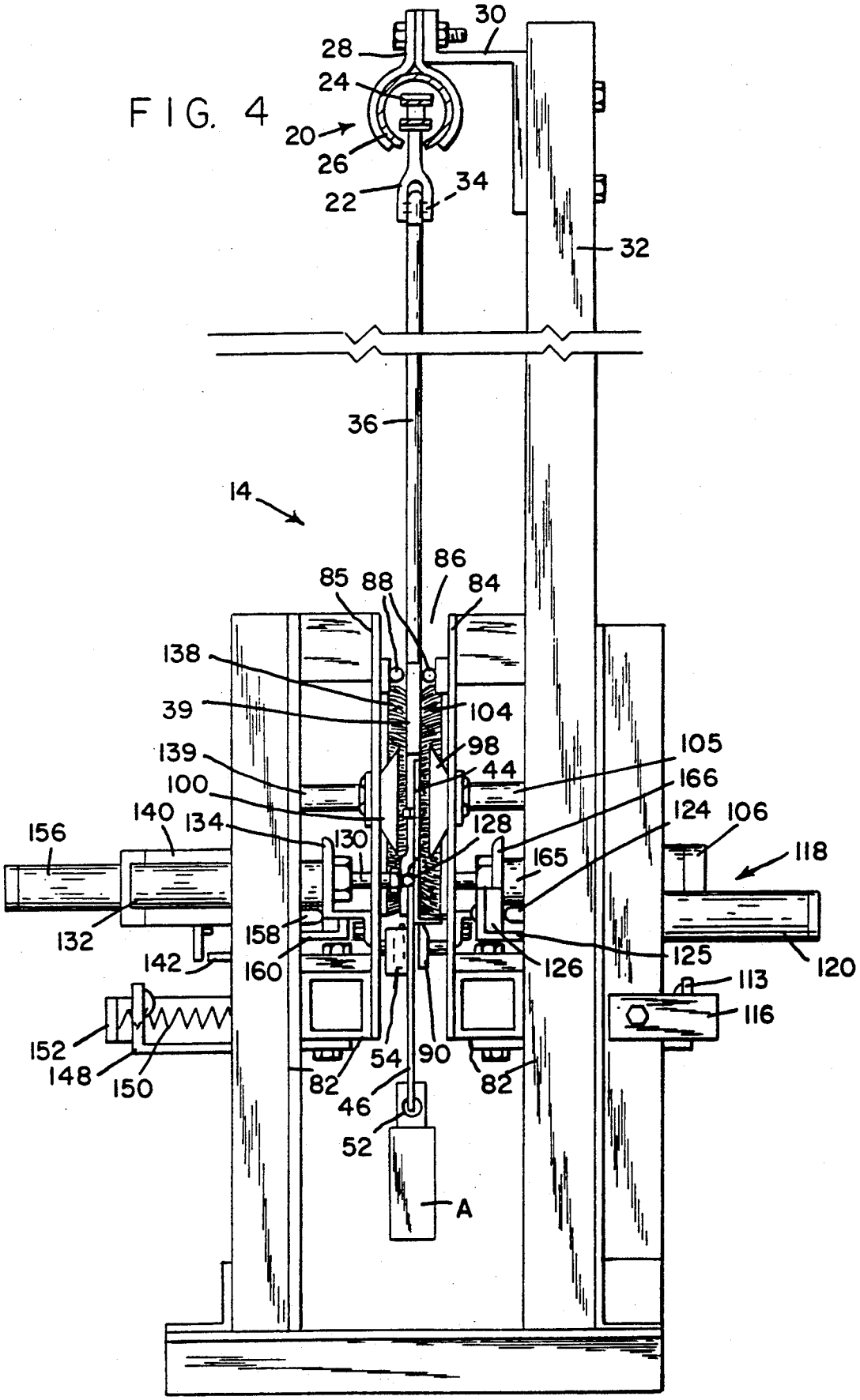
FIG. 4 is an end elevational view of the left or entry end of the cleaning station.
Figure 5:
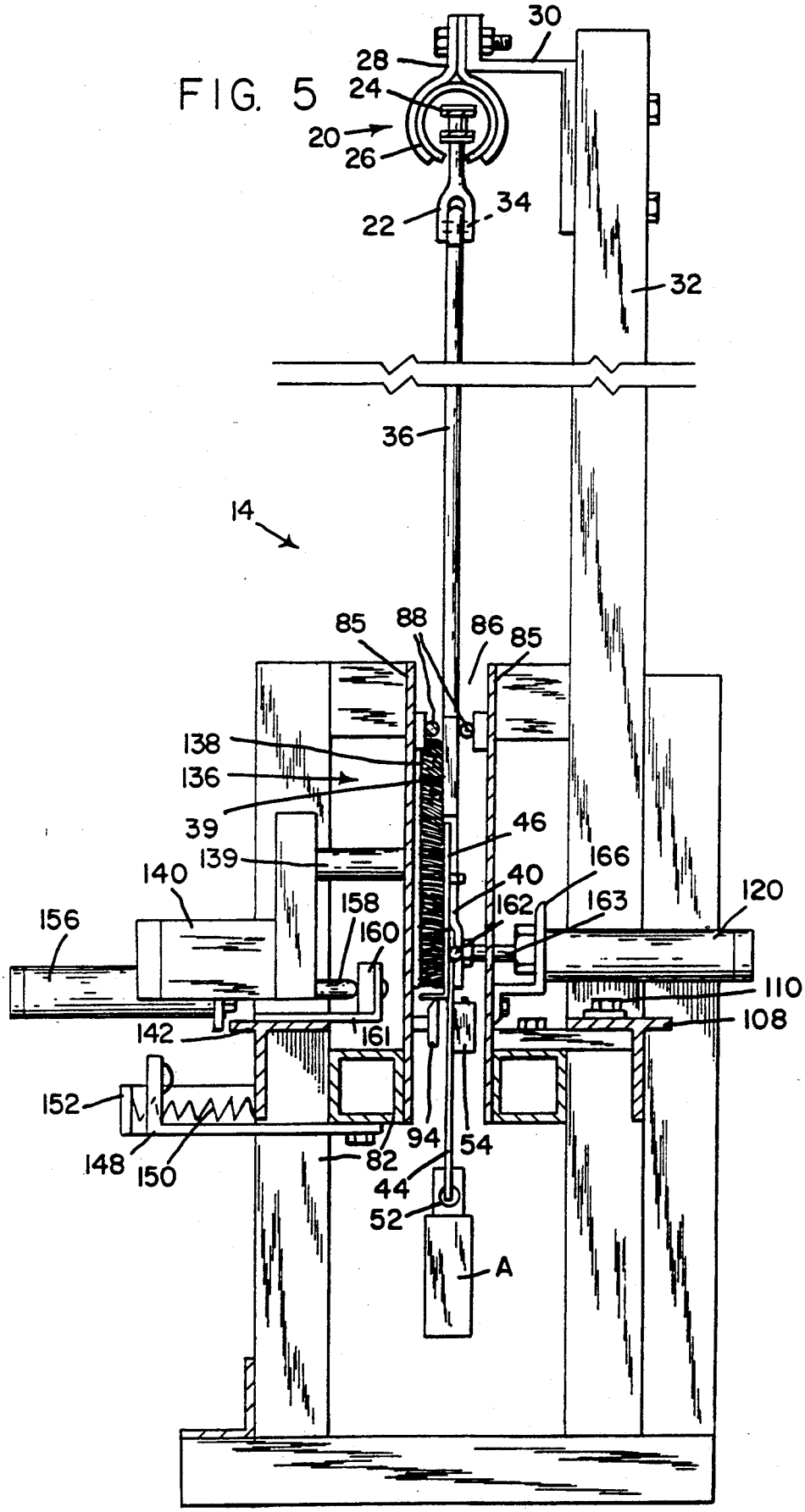
FIG. 5 is a vertical cross-sectional view of the cleaning station taken along the line V—V of FIG. 2.

Referring also to FIGS. 4 and 5, the overhead conveyer 20 comprises a plurality of clips 22 which are fixed to a horizontal chain which is driven horizontally within a guide tube 26 above the article coating system by drive means, not shown. The tube 26 is supported in clamps 28 which are mounted on brackets 30 which are, in turn, fixed to supporting posts 32. The conveyer 24 extends in a complete loop and the tube 26 is supported by additional supporting posts, not shown.

Figure 6:
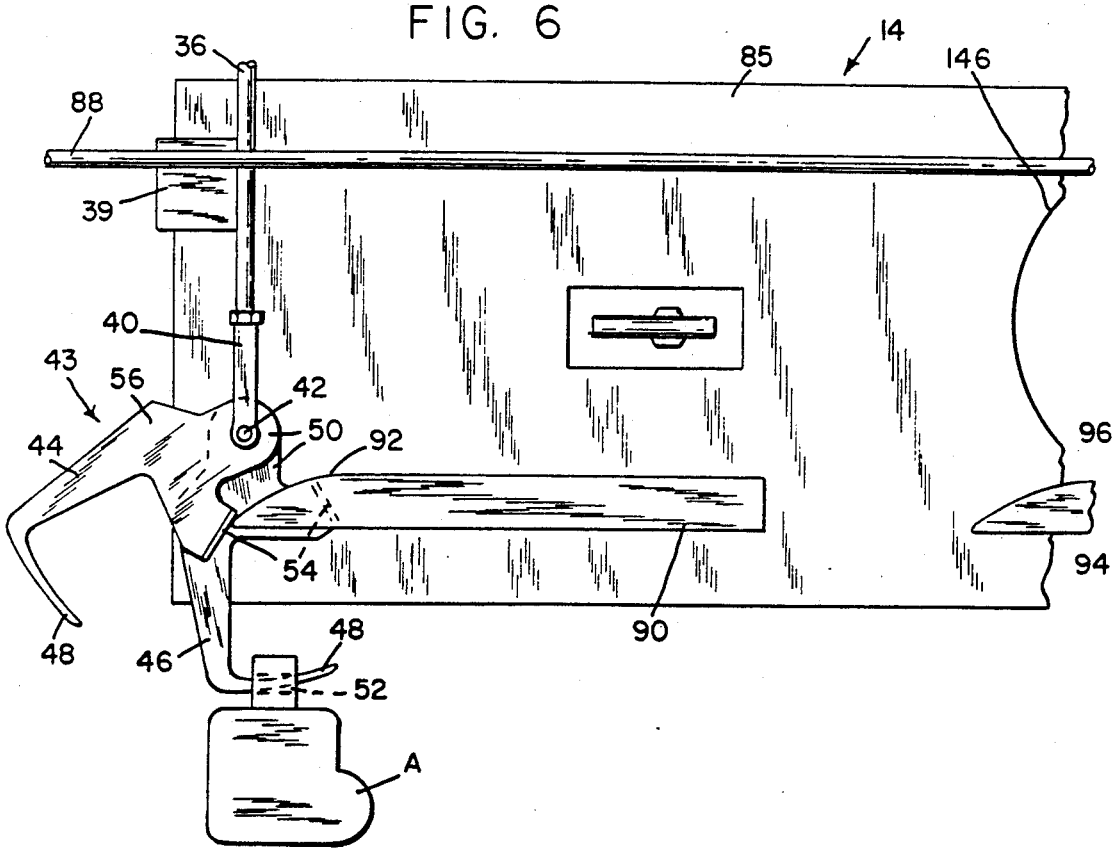
FIG. 6 is a fragmentary operational view from inside the cleaning station showing one of the carriers being moved away from its article supporting position prior to cleaning.

Each clip 22 includes a horizontal pin 34. Each hanger 18 comprises a connector such as a rod 36 which has a hook 38 at one end for suspension on the pin 34 of one of the clips 22. Referring also to FIG. 6, the lower end of the rod 36 is fixed to a clevis 40 which supports a horizontal pin 42 for supporting a carrier assembly, generally indicated by the reference numeral 43. The carrier assembly 43 comprises a forward carrier 44 and a rearward carrier 46, each of which is independently pivotally mounted on the pin 42. Each of the carriers 44 and 46 comprises a lower hook shaped projecting free end portion 48 and an upper portion 50 which is pivotally mounted on the pin 42. Each of the carriers 44 and 46 consist of a flat plate which has a laterally extending flange 54. The flanges 54 of the carriers 44 and 46 extend in opposite directions away from the main bodies of the carriers. When the carriers 44 and 46 are in their normal lower suspended position the flanges 54 are on one side of a vertical line which extends through the pivot pin 42, an enlarged section 56 is located on the opposite side of the vertical line from the flanges 54 to act as a counter-weight for the flange 54. The carriers 44 and 46 are freely suspended and are balanced to remain in perfect alignment with each other so that their inner flat surfaces abut. This prevents particles from being deposited on the inner flat surfaces of the carriers when they are transported through spray booth. Each connector rod 36 has a guide plate 39 affixed thereto to maintain the carriers 44 and 46 within the plane of travel during certain phases of the coating system.

Figure 10:
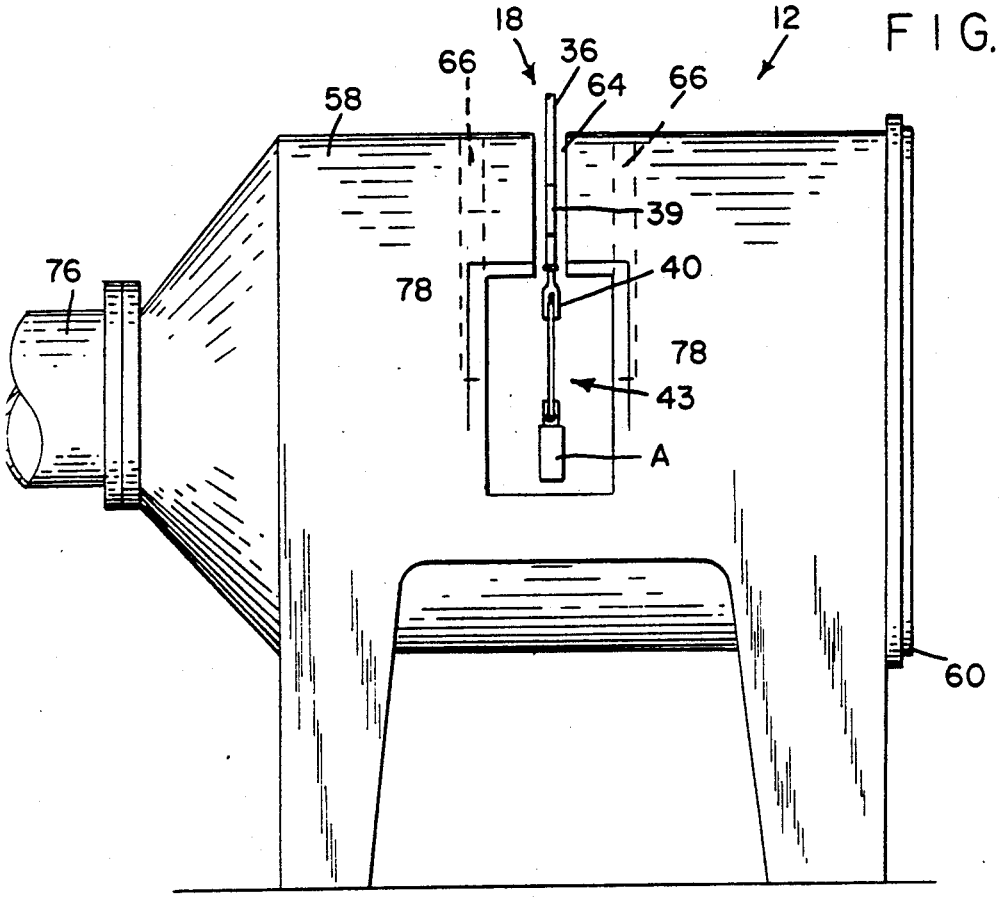
FIG. 10 is an elevational view of the left or entry end of the spray booth.
Figure 11:
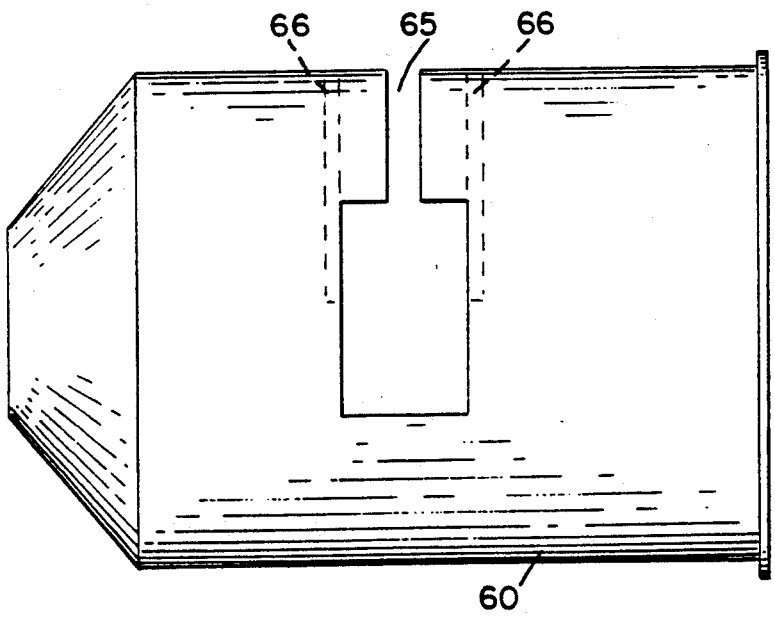
FIG. 11 is an end elevational view of the insert for the spray booth.

Referring particularly to FIGS. 1, 10, and 11, the spray booth 12 comprises a cylindrical housing 58 which has a cylindrical chamber and a circular front opening. The housing 58 contains a removable cylindrical insert 60 which has a cylindrical chamber 61 and a circular front opening 62. The insert 60 has a vertical slot 64 which is aligned with a vertical slot 64 in the housing 58 when the insert 60 is located within the housing 58. Slots 64 and 65 allow the articles to be coated and the hangers 18 to pass through the chamber 61 along a path in direction which is transverse to the central longitudinal axis of the chamber. The upper portion of each of the slots 64 and 65 is relatively narrow to allow for the passage of the rods 36 while the lower portion of each slot is relatively wide to accommodate the range of articles to be coated. Flanges 78 are located on opposite side of the slot 65 at each end of the slot and cooperate with the guide plates 39 to properly align the articles to be coated as they enter and leave the chamber 61. Most articles require turning within the chamber 61 in order for the article to be completely coated. This is accomplished by attaching an adapter to the clip 22, referred to in the trade as a spinner, and attaching the hook 38 to the spinner. Rotation of the spinner is controlled by fixed camming pins which cause the article to be rotated in a precise sequence. This mechanism is not shown but well known in the coating art. The chamber 61 is divided into a lower flow channel 68 and an upper flow channel 72 by a pair of vertical baffles 66 which are located on opposite sides of the slot 65. The upper limit of the lower flow channel 68 is defined by the lower edges 67 of the baffles 66. The upper portion of each baffle 66 has a pair of apertures 70 which provide entrance openings to the upper channel 72. An exhaust opening 74 is located at the back of the chamber 61 and is operatively connected to an exhaust duct 76. A grate 80 is located in front of the exhaust opening 74. Exhaust dust 76 is connected to a source of sub-atmospheric pressure which creates an air flow from the front opening 62 to the exhaust opening 74. However, two separate air flows are created within the chamber 61, due to the baffles 66. The lower air flow in the flow channel 68 contains the ionized particles to be deposited on articles which are transported through the spray booth. The upper air flow in the upper channel 72 is void of particles and helps to maintain the particles in the lower flow channel 68 until they reach the exhaust opening 74. The lower edges 67 of the baffles are positioned just above the workpiece to minimize the amount of coating which is deposited on the carriers. The particles are deposited by electrode units which charge and ionize the particles and the particles are attracted to the metalic articles A which are grounded though their contact with the metalic hangers 18. The hangers 18 are, in turn, grounded through their contact with the conveyer system 20. Any particles which are not deposited on the articles are drawn into the exhaust duct 76 to be subsequently collected and recycled. After the articles A are coated with the ionized particles, they are conveyed from the spray booth 12 to the cleaning station 14.

Referring particularly to FIGS. 1-5 the cleaning station 14 comprises framework 82 which supports a pair of spaced vertical plates 84 and 85 which define a cleaning zone 86 therebetween. A pair of horizontal guide rods 88 are fixed to the plates 84 and 85 and are in alignment with the guide flanges 39 of the connector rods 36 for maintaining the carriers 44 and 46 within the plane of travel through the cleaning zone 86.

Figure 7:
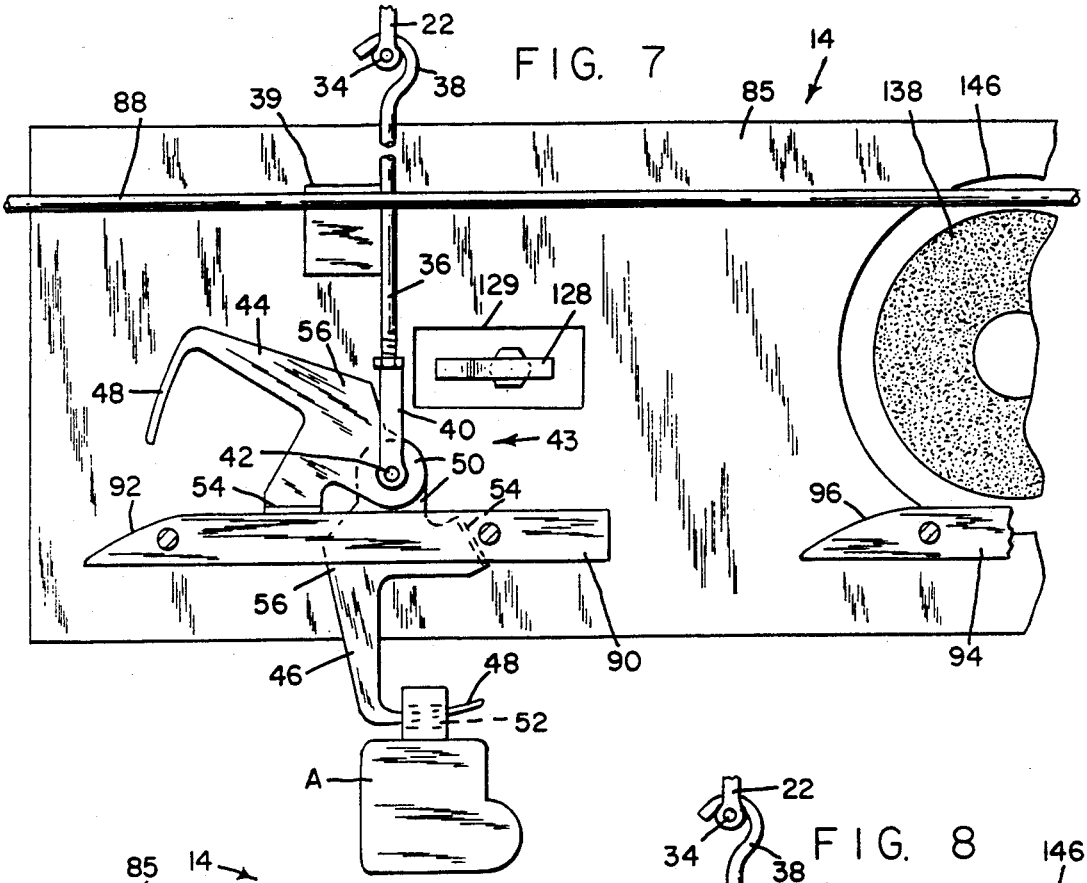
FIG. 7 is a view similar to FIG. 6 showing the first carrier in the cleaning position.
Figure 8:
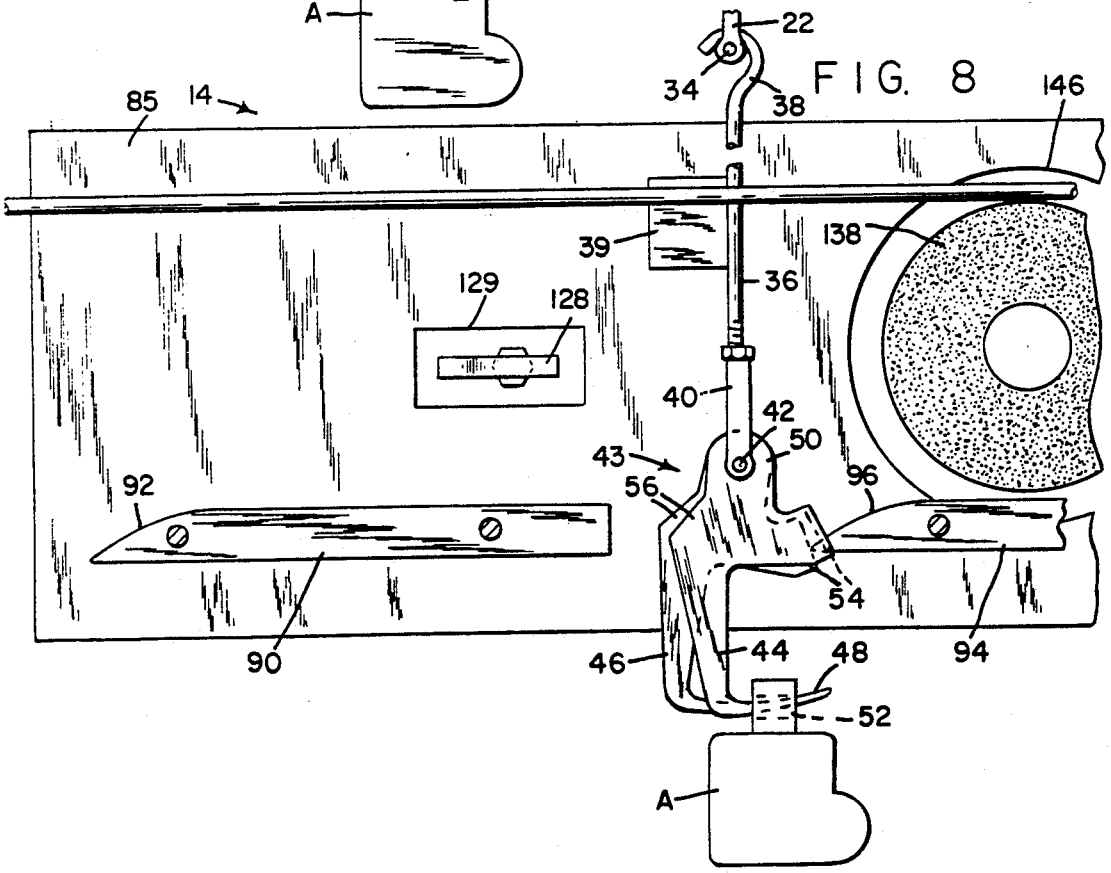
FIG. 8 is a view similar to FIGS. 6 and 7 showing the second carrier being moved away from its article supporting position.
Figure 9:
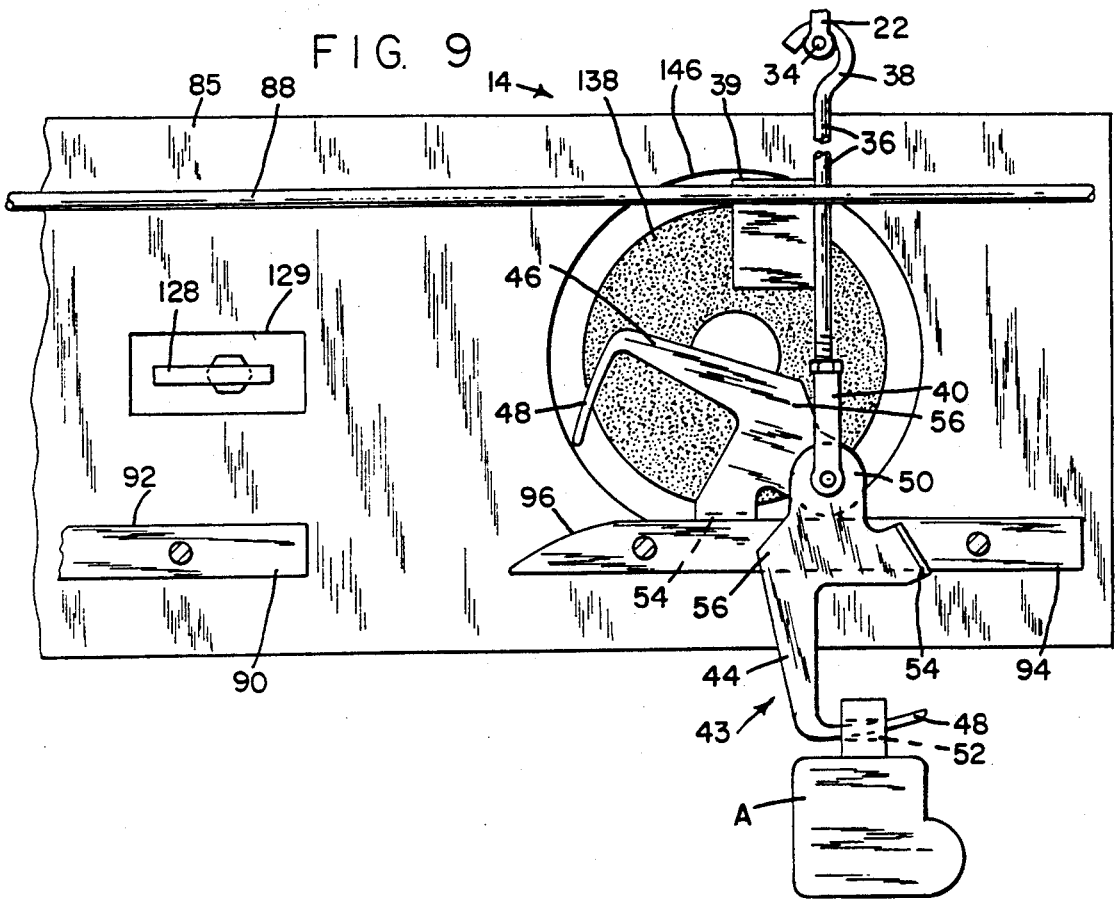
FIG. 9 is a view similar to FIGS. 6–8 showing the second carrier in its cleaning position while the article is supported by the first carrier.

Referring to FIGS. 6-9 a front cam 90 having an upper cam surface 92 is fixed to the front cam plate 84. An identical rear cam 94 having an upper cam surface 96 is fixed to the rear plate 85. When the carrier assembly 43 enters the cleaning zone 86, flange 54 of the front carrier 44 engages the cam surface 92 of the front cam 90. This causes the carrier 44 to pivot about the pin 42 and out of supporting engagement with the article A, thereby leaving article A fully supported by the carrier 46 as shown in FIG. 6. The projecting free end portion 48 is in supporting engagement with the article A as for example by extending through an aperture 52 in the article A. As the carriers 44 and 46 proceed through the cleaning zone 86, carrier 44 is raised to its cleaning position as shown in FIG. 7. When the flange 54 of the carrier 44 reaches the end of the cam 90, it drops back into engagement with the article A. Just after the extending portion 48 of the carrier 44 enters the aperture 52 of the article A, the flange 54 of the carrier 46 engages the cam 90 so that its projecting portion 48 begins to leave the aperture 52 as shown in FIG. 8. The carrier 46 is thereafter raised to its upper cleaning position as shown in FIG. 9, thereby leaving the article A fully supported by a front aperture 44. This enables the front and rear apertures 44 and 46, respectively, to be cleaned in succession while collectively maintaining supporting control of the article A through the cleaning station 14.

Referring particularly to FIGS. 2-5, each carrier 44 and 46 is cleaned by a two-step process which comprises removing most of the particles by a blast of air, and removing the remaining particles by a rotating brush. The first cleaning step is provided by a fan-shaped air nozzle 98 which is fixed to the front plate 84. The nozzle 98 is in horizontal alignment with the projecting portion 48 of the carrier 44 when the carrier 44 is in the position shown in FIG. 7. A blast of air from the nozzle 98 removes more than 90% of the particles from the carrier 44. An identical air nozzle 100 is fixed to the plate 85. The nozzle 100 is in horizontal alignment with the carrier 46 when the carrier is in the position shown in FIG. 9 for removing more than 90% of the particles from the carrier 46.

The nozzles 98 and 100 are operatively connected to a valve, not shown, which is actuated by an air switch 101 which is mounted on the guide tube 26. The valve is operatively connected to a source of pressurized air, not shown. The air switch 101 is normally closed and includes a switch arm which is engaged by each clip 22 as the clip passes by the air switch 101 to open the switch. When the air switch 101 is opened, the valve which it controls causes the nozzles 90 and 100 to deliver a blast of air into the cleaning zone 86. The spacing between the clips 22 is equal to the spacing between the nozzles 98 and 100. This means that the carriers 44 of the carrier assembly 43 which near the entry end of the cleaning zone is cleaned by a blast of air from the nozzle 98, while the carrier 46 of the carrier assembly 43 which is near the exit end of the cleaning zone is cleaned by a blast of air from the nozzle 100.

Figure 2:
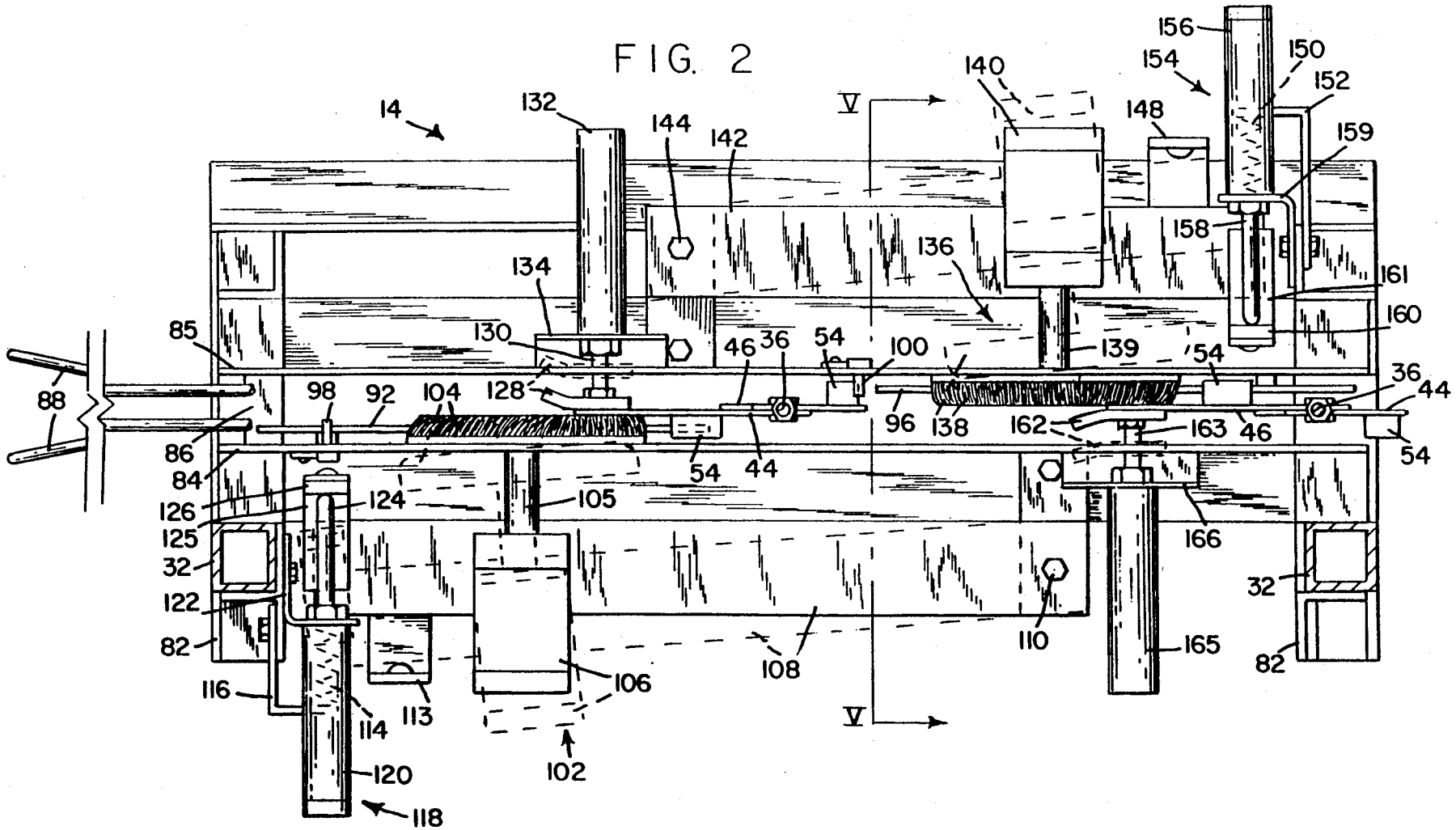
FIG. 2 is a plan view of the cleaning station for the article carriers.
Figure 3:
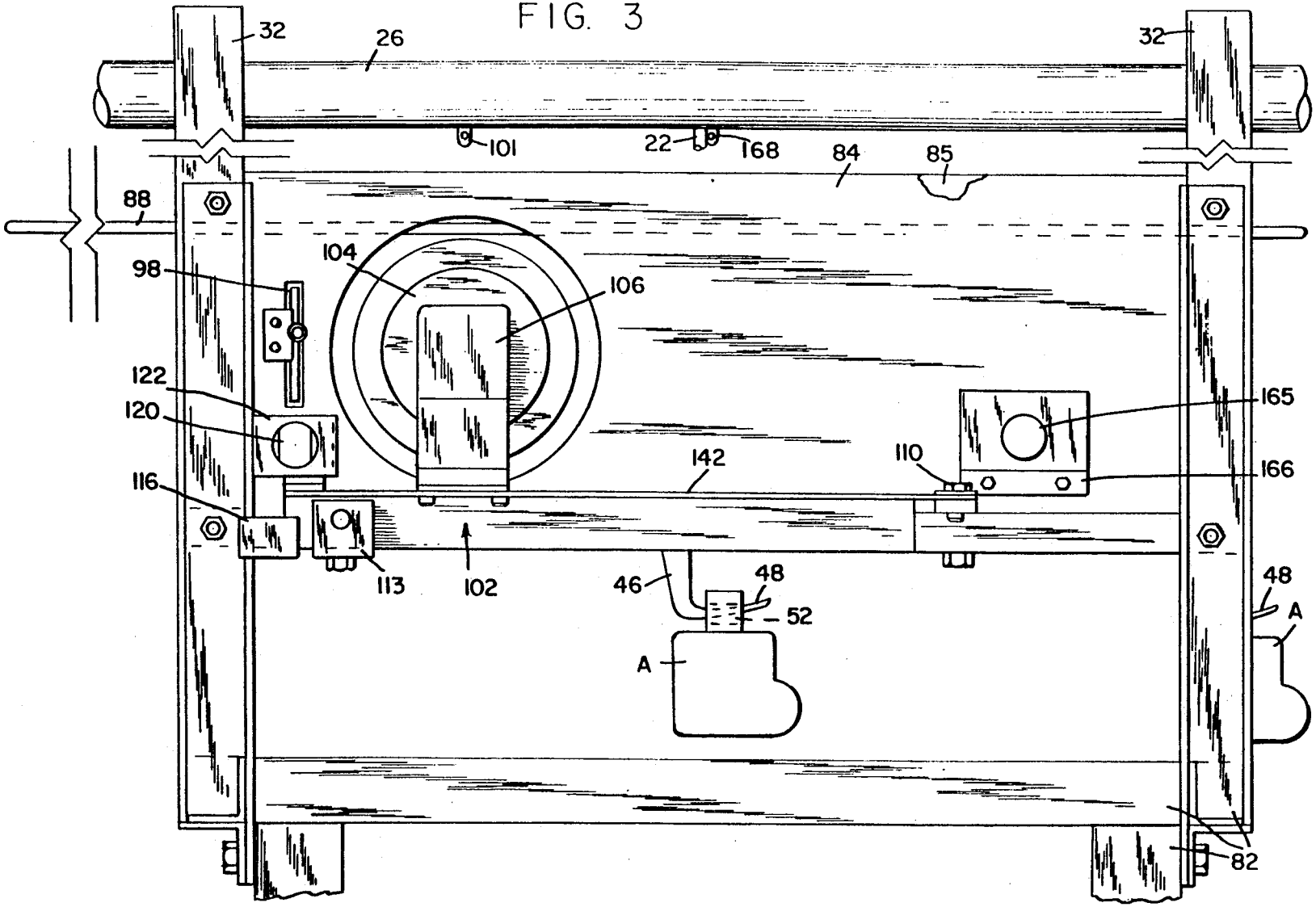
FIG. 3 is a front elevational view of the cleaning station.

The second cleaning step for the carriers 44 is provided by a brush assembly which is generally indicated by the reference numeral 102, see particularly FIGS. 2 and 3. The brush assembly 102 comprises a circular brush 104 which is mounted for rotation with a shaft 105 which is rotatably driven by a motor driven drive assembly 106. The drive assembly 106 is mounted on a horizontal beam 108 which is pivotally mounted on a horizontal portion of the framework 82 by means of a vertical pivot bolt 110. Beam 108 is pivoted about the vertical axis of the bolt 110 from its outer inactive position shown in dotted lines in FIG. 2 to its inner active position shown in full lines in FIG. 2. When the beam 108 is in its outer position, the brush 104 is outside of the cleaning zone 86 as show in dotted lines in FIG. 2. When the beam 108 is in its inner position, brush 104 extends through a circular opening 112 in the plate 84 (see FIG. 1) and into the cleaning zone 86 as shown in full lines in FIG. 2. The beam 108 is normally maintained in its outer position by a tension spring 114 which is anchored to a bracket 116 which is fixed to the framework 82. The beam 108 is moved to its inner position by a pneumatic actuating means, generally indicated by the reference numeral 118. The actuating means 118 comprises a pneumatic cylinder 120 which is fixed to the framework 82 by means of a mounting bracket 122. The cylinder 120 contains a piston 124 which is driven outwardly from the piston 120 toward the plate 84 when the cylinder 120 is actuated. The end of the piston 124 engages a pad 126 of material having a low coefficient of friction and high resistance to impact such as nylon. The pad 126 is fixed to the vertical portion of an L-shaped bracket 125 which is mounted on the beam 108. Movement of the piston 124 outwardly from the cylinder 120 causes the beam 108 to move inwardly toward the plate 84 by virtue of its contact with the pad 126. When the cylinder 120 is in its non-actuated state, the piston 124 is withdrawn into the cylinder by means of an internal spring 121, see FIG. 12, and the beam 108 is returned to its outer position by the spring 114. The outer position of the beam 108 is determined when the beam 108 strikes a stop bracket 113. An elongated opposer member in the form of a cylindrical rod 128 is moved into and out of the cleaning zone 86 in synchronism with the brush 104 from the opposite side of the cleaning zone. The opposer rod 128 is fixed to a piston 130 which is driven axially by a pneumatic cylinder 132 from an outer inactive position shown in dotted lines in FIG. 2 to an active inner position shown in full lines in FIG. 2. The pneumatic cylinder 132 is mounted on a bracket 134 which is fixed to the plate 85. A spring 133, see FIG. 12, within the cylinder 132 maintains the piston 130 in its inactive withdrawn state which positions the opposer rod 128 outside of the cleaning zone 86. When the pneumatic cylinder 132 is actuated, the piston 130 is extended to move the opposer rod 128 through an opening 129 in the plate 85 and into the cleaning zone cell 86 towards the brush 104. The cylinders 120 and 132 are actuated simultaneously after the front carrier 44 has been cleaned by the air nozzle 98 and the carrier 34 has advanced to the position shown in FIG. 2. When the pneumatic cylinders 120 and 132 are actuated, brush 104 and the opposer rod 128 move towards each other and engage the lower portion of the carrier 44 therebetween. The action of the brush 104 removes the remaining particles from the outer surface of the carrier 44.

Thereafter, the cylinders 120 and 132 are deactivated, thereby causing the brush 104 and the opposer member 128 return to their outer inactive positions.

As the carrier assembly 43 continues to travel through the cleaning zone 86, the carrier 46 is raised to its upper cleaning position by the cam 94 and a blast of air is delivered to the outer surface of the carrier 46 by the air nozzle 100 when the lower portion of the carrier 46 is horizontally aligned with the air nozzle 100. The second or brushing step of the cleaning cycle for the carrier 46 is accomplished by a brush assembly which is generally indicated by the reference numeral 136. The brush assembly 136 comprises a circular brush 138 which is mounted for rotation with a shaft 139 which is rotatably driven by a motor-driven drive assembly 140. The drive assembly 140 is mounted on a horizontal beam 142 which is pivotally mounted on a horizontal strut on the framework 82 by means of a vertical pivot bolt 144. The beam 142 is movable about the vertical axis of the pivot bolt 144 between an outer position shown in dotted lines in FIG. 2 to an inner position shown in full lines in FIG. 2. Beam 142 is maintained in its outer position against a stop bracket 148 by means of a tension spring 150 which is fixed to the framework by means of a mounting bracket 152. When the beam 142 is in its outer position, the brush 138 is located outside of the cleaning zone 86. When the bracket 142 is moved to its inner position, the brush 138 passes through a circular opening 146 in the plate 85, see FIGS. 6–9, and into the cleaning zone 86. The beam 142 is moved to its inner position by means of a pneumatic actuator 154 which is generally indicated by the reference numeral 154. The pneumatic actuator 154 comprises a pneumatic cylinder 156 and a piston 158 which is movable axially into and out of the cylinder 156. When the cylinder 156 is in its inactive state, the piston 158 is withdrawn within the cylinder 156 by means of an internal spring 157, see FIG. 12. When the pneumatic cylinder 156 is actuated, the piston 158 is extended towards the plate 85. The cylinder 156 is fixed to the framework 82 by means of a mounting bracket 159. When the piston 158 is extended from the cylinder 156, the end of the piston engages a pad 160 of material having a low coefficient of friction and high resistance to impact such as nylon. The pad 160 is fixed to the vertical portion of an L-shaped bracket 161 which is fixed to the beam 142. This causes the beam 142 to move towards the plate 85 and causes the brush 138 to move into the cleaning zone 86 as shown in full lines in FIG. 2.

An elongated opposer member in the form of a cylindrical rod 162 is located on the opposite side of the cleaning zone 86 and is fixed to a piston 163 which is movable axially within a pneumatic cylinder 165. The cylinder 165 is fixed to the plate 84 by means of a mounting bracket 166. When the cylinder 165 is deactivated, an internal spring 167, see FIG. 12, maintains the piston 163 withdrawn into the cylinder 165. When the cylinder 165 is actuated the piston 163 is extended to move the opposer rod 162 through an opening in the plate 84 and into the cleaning zone 86 from its outer inactive position shown in dotted lines in FIG. 2 to its active position shown in full lines. The cylinders 156 and 165 are actuated simultaneously so that the opposer rod 162 and the brush 138 move towards each other the carrier 46 is in the position shown in FIG. 2 thereby trapping the lower portion of the carrier 46 therebetween and enabling the brush 138 to remove the remaining particles from the outer surface of the carrier 46 to complete the cleaning operation for the carrier 46. As the carrier 46 slips away from the cleaning brush 148, the cylinders 140 and 165 are deactivated to return the opposer rod 162 and the brush 138 to their outer inactive positions.

Figure 12:
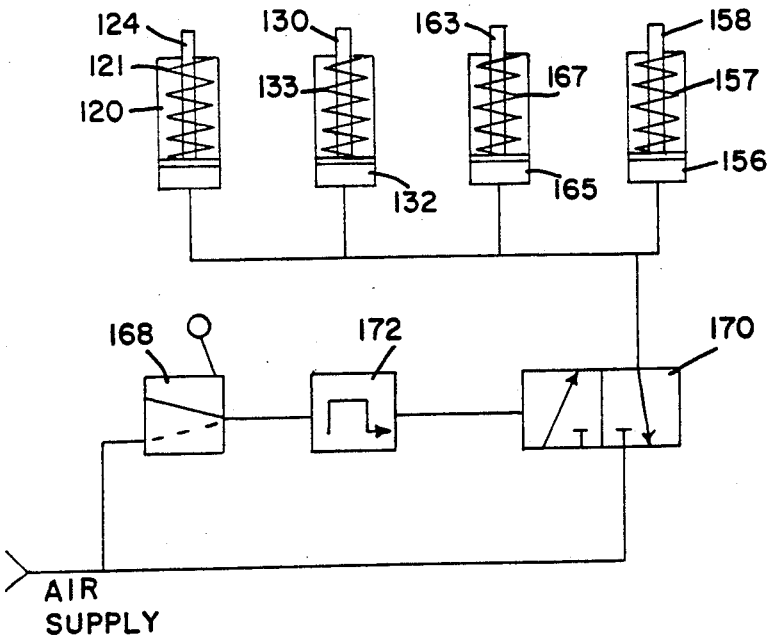
FIG. 12 is a schematic diagram of the pneumatic actuating system for the cleaning station.

Referring to FIGS. 3 and 12, the cylinders 120, 132, 165, and 155 are operatively connected to a valve 170 which is actuated by a valve or air switch 168 which is mounted on the guide tube 26. The valve is operatively connected to a super atmospheric air supply, not shown. The air switch 168 is normally closed and includes a switch arm which is engaged by each clip 22 as the clip passes by the air switch 168 to open the switch. When the air switch 168 is opened, the cylinders 120, 132, 165, and 156 are operatively connected to the super atmospheric air supply through the valve 170 and actuated simultaneously. The spacing between the clips 22 is equal to the spacing between the brush assemblies 102 and 154. This means that carriers 44 of the carrier assembly 43 which is near the entry end of the cleaning zone is cleaned by the brush 104 as shown in FIG. 2, the carrier 46 of the carrier assembly 43 which is near the exit end of the cleaning zone is cleaned by the brush 138, as also shown in FIG. 2. The valve 170 is connected to the air switch 168 through a pulse generator 172 which causes the cylinders 120, 132, 156, and 165 to be actuated for approximately 0.4 seconds. The air switch 168, the pulse generator 172, and the air valve 170 are all products of Crouzet Control Incorporated of Schaumbury, Illinois. Air switch 168 is identified as model no. 81-921701. The pulse generator 172 is identified as model no. 81-507540 and the air valve 170 is identified as model no. C-20151-40. The cylinders 120, 132, 156, and 165, are products of Parker Hannifir Corporation of Cleveland Ohio and identified as model no. 0.75NRSR01.5.

The carriers 44 and 46 carry the article A out of the cleaning station 14 and into the curing oven 116, wherein the particles which are coated on the article A are cured to form a permanent coating on the article. However, since the particles remain on the carriers 44 and 46, no coating is formed on the carriers and they are ready to be used again without any deleterious effect for carrying another article through the coating system. The cleaning zone 86 is preferably, shrouded as much as possible to create a plenum. A vacuum system is operably connected to the plenum for evacuating air from the plenum to collect the particles which are removed from the carriers 44 and 46 for subsequent reprocessing.

The article coating system which is shown and described is specifically adapted for coating articles with electrostatically charged particles in a solid or powder form such as uncured resin particles. The carrier assembly and spray booth could also be used for coating an article with electrostatically charged paint particles. However, the carriers have to be cleaned differently than they are for powder particles. A spray of paint solvent has to be used instead of a blast of air as the first cleaning step. Thereafter, the paint and solvent are wiped from the carrier by an appropriate wiping agent such as a cloth covered brush.

I claim:

1. A spray booth for applying a coating of loose particulate material to an article having a configuration which enables the article to be suspended on the end of a projecting element which is suspended from an overhead conveyor for transporting the article along a predetermined horizontal path, through the spray booth, said spray booth comprising:

(a) a housing having: a horizontal spray channel which extends transversely to said path of travel of the article, a main opening to said spray channel for introducing a spray of particulate material into said spray channel, an exhaust opening opposite said main opening, and a vertical slot which is located between said main opening and said exhaust opening and which extends transversely to said spray channel and coincident with the path of travel of said article, so that said article passes through said vertical slot and across said spray channel as the article moves along said path, and (b) a baffle which is located between said vertical slot and said main opening, said baffle being located in the upper part of said housing, and having a horizontal lower edge which defines the upper limit of said spray channel so that only the projecting element and the article extend down into said spray channel.

2. A spray booth for applying a coating of loose particulate material to an article having a configuration which enables the article to be suspended on the end of a projecting element which is suspended from an overhead conveyor for transporting the article along a predetermined horizontal path, through the spray booth, said spray booth comprising:

(a) a housing having: a horizontal spray channel which extends transversely to said path of travel of the article, a main opening to said spray channel for introducing a spray of particulate material into said spray channel, an exhaust opening opposite said main opening, and a vertical slot which is located between said main opening and said exhaust opening and which extends transversely to said spray channel and coincident with the path of travel of said article, so that said article passes through said vertical slot and across said spray channel as the article moves along said path, and (b) a liner which is removably mounted in said housing and which defines said spray channel, said liner having an opening which is coextensive with the main opening of said housing and a vertical slot which is coextensive with the vertical slot of the housing when the liner is positioned within the housing.

* * * * *